United States Patent [19]

Wyman

[11] Patent Number: 5,054,776

[45] Date of Patent: Oct. 8, 1991

[54] FOLDABLE POOL TABLE COVER

[76] Inventor: Robert W. Wyman, 4389 Trail St., Norco, Calif. 91760

[21] Appl. No.: 588,810

[22] Filed: Sep. 27, 1990

[51] Int. Cl.[5] ..... A63B 71/00

[52] U.S. Cl. ..... 273/13; 5/465

[58] Field of Search ..... 273/13, 6, 3 R, 3 A, 273/3 B, 7, 5 C, 2; 5/27, 28, 32, 448, 465, 476; D6/596, 383, 392, 605, 391, 503

[56] References Cited

U.S. PATENT DOCUMENTS

| | | | |
|---|---|---|---|
| 836,326 | 11/1906 | Kinyon | 5/465 |
| 1,423,954 | 7/1922 | Mausser | 5/465 |
| 1,549,289 | 8/1925 | Bradley | 5/465 |
| 2,468,962 | 5/1949 | Czak . | |
| 2,556,943 | 6/1951 | Reisman . | |
| 2,572,333 | 10/1951 | Greitzer . | |
| 2,634,183 | 4/1953 | Derman . | |
| 2,954,635 | 10/1960 | Stotter . | |
| 3,048,459 | 8/1962 | Moore . | |
| 3,419,920 | 1/1969 | Maddux, Jr. et al. | 5/465 |
| 3,455,551 | 7/1969 | Untiedt | 273/6 |
| 3,659,297 | 5/1972 | Schutz | 5/465 |
| 4,004,305 | 11/1977 | Rubin | 5/465 |
| 4,190,918 | 3/1980 | Harvell | 5/465 |
| 4,794,658 | 1/1989 | Goodale | 5/448 |

*Primary Examiner*—Theatrice Brown

*Attorney, Agent, or Firm*—Gordon K. Anderson

[57] ABSTRACT

A foldable pool table cover which has a pliable fabric top (20) the approximate size of a pool table with a fold (22) in the center. A number of rectangular blocks (24) having a thickness equal to the recess in the pool table are positioned side by side under the top completely filling the recessed area of the pool table creating a level surface for the top. A skirt (26) is attached on the periphery of the top split in the middle and a block covering (32) encloses the blocks for attachment and protection. Integral hinging surfaces (36) located on the fold in the top and between matching pairs of blocks allow the cover to be doubled over with one block on top of the other for storage when not in use.

11 Claims, 3 Drawing Sheets

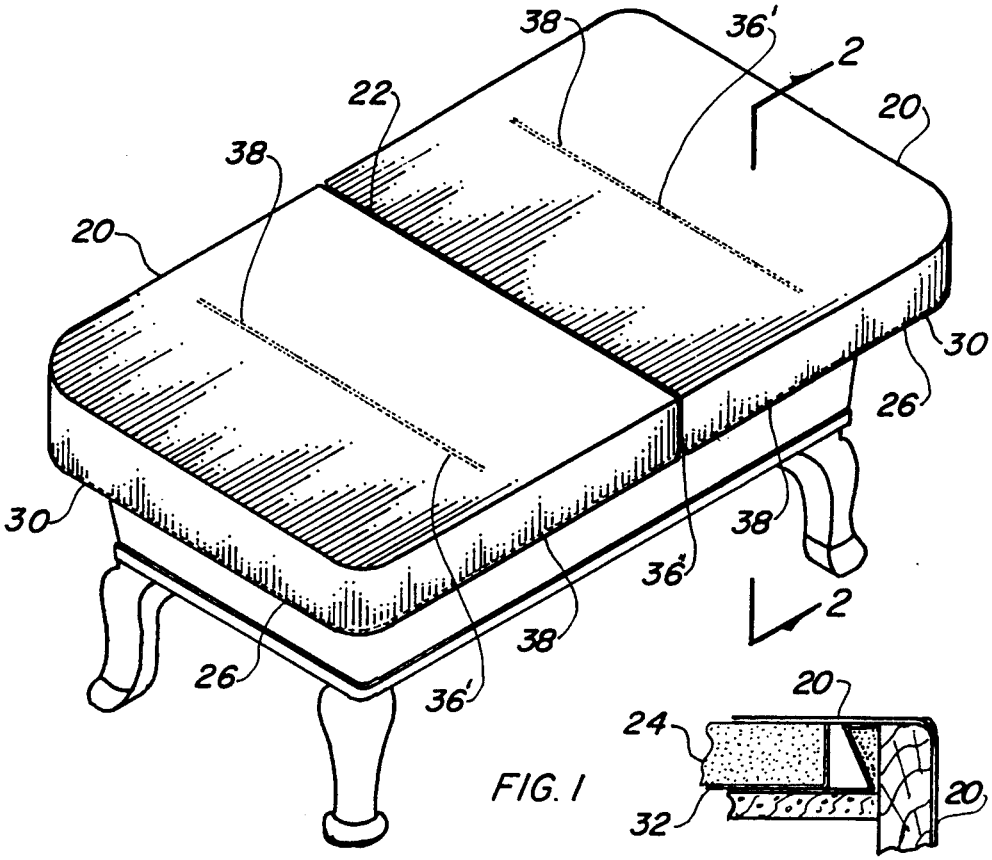
FIG. 1
FIG. 2
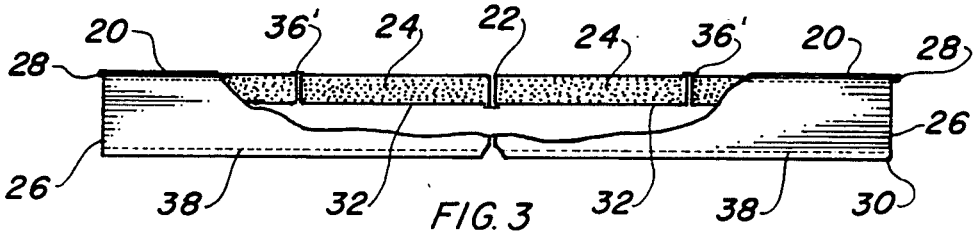
FIG. 3
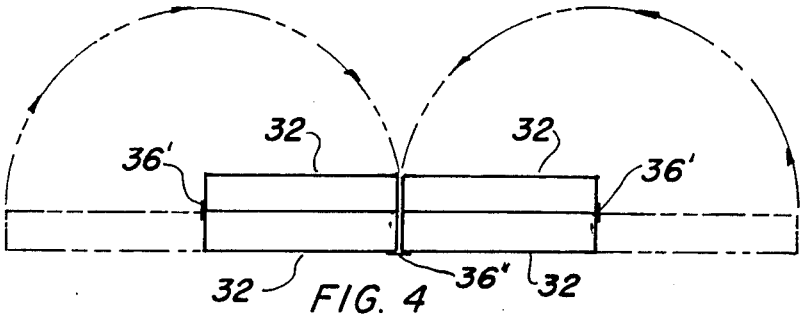
FIG. 4

FOLDABLE POOL TABLE COVER

TECHNICAL FIELD

The present invention relates to covers for tables in general. More specifically, to table covers that produce a level surface on a pool table and are foldable for storage.

BACKGROUND ART

Previously, many types of covers have been used to protect the tops of tables against physical abuse and to extend the utility. There are two major categories of covers, the first using a flexible pliant material, either singly or backed with a resilient substance used primarily on a flat table. The second adds more protection by including a rigid structural surface hinged together and positioned on top of the table for protection and, in some cases, to extend the surface. Pool tables are normally covered by a simple cloth or may be used as a dining or buffet table by the addition of flat rigid panels that span the recessed playing surface to accommodate the dual usage.

A search of the prior art did not disclose any patents that read directly on the claims of the instant invention, however, the following U. S. Patents were considered related:

| U.S. Pat. No. | Inventor | Filing Date |
|---|---|---|
| 3,048,459 | Moore | Aug. 7, 1962 |
| 2,954,635 | Stotter | Oct. 4, 1960 |
| 2,634,183 | Derman | Apr. 7, 1953 |
| 2,572,333 | Greitzer | Oct. 23, 1951 |
| 2,556,943 | Reisman | Jun. 12, 1951 |
| 2,468,962 | Czak | May 3, 1949 |

Moore teaches a convertible table having a top suggesting a dining table, however, when removed through the use of interlocking brackets, a game field is available suitable for playing pool or billiards.

Stotter takes the first approach described employing a laminated vinyl cover with a soft and resilient foam backing. In order to fold and achieve a desirable deadhang characteristic of the drop panels, the foam is omitted and the vinyl is set-scored on the creases. This procedure allows the cover to conform smartly to the shape of the table and presents cushioned panels on the top and all side faces of the table.

Derman teaches a card table top using four similar paperboard quarter sections hinged together leaving some sections free to fold into the minimum space. The rigid sections have curved outer peripheral edges allowing a square table, such as a collapsible card table to be extended into a round configuration.

Greitzer discloses a two surface table, one underneath, consisting primarily of a large central matted area bordered by pockets or recesses. The top surface is in two or more parts that slide outward for removal or are locked into position to form a larger dining surface.

Reisman employs a supplementary table top of rigid material which may be securely fixed over a smaller table. The top is held in place by blocking members and clamping members disposed under the top interfacing with the parent table.

Czak directs his attention to extending the surface of a card table using strips under the top and hinges to allow the rigid top to fold into a small space.

It will be noted that prior art has limited its direction to rigid tops that attach in some manner and are folded for storage. While Stotter looks toward a pliable top, his direction is limited to using soft foam backing for matting only.

DISCLOSURE OF THE INVENTION

It may be clearly seen that in the past little has been done with pool or billiard tables to allow dual usage that provides both a protective cover and a useable top surface. Pool tables generally have a different problem than other tables in that the playing surface is recessed as much as 1.75 inches (4.5 cm), therefore, a fabric or thermoplastic cover would simply dip downward in the center onto the carpet and be difficult to use as a table. The use of a rigid cover allows utility as a conventional flat table, however, the material must be structurally strong enough to bridge from one side to the other and is necessity heavy and usually expensive. It is, therefore, the primary object of the invention to provide a protective, waterproof cover that includes a lightweight structure filling the table recess and providing a level, smooth surface allowing either a pool or billiard table to be used as a dining or buffet table interchangeably.

An important object of the invention is directed to the ability of the cover to be folded compactly for storage. As an example, the invention used on a standard seven foot pool table folds into an envelope 19.50 inches (39.5 cm) long by 39 inches (99 cm) wide by 7 inches (17.8 cm) high.

Another object of the invention affords protection of the pool table, as it is not only waterproof, but protects the carpet and bumpers from heat as the cover is a thermal insulator by its very nature. Hot liquids, spills, etc., are easily taken care of on the top surface and the peripheral skirt protects the wood on the sides from any adverse effects originating from items placed on the top surface.

Still another object of the invention is the ease of handling, as the cover is not only compact, but readily handled by one person due to its lightness. As an example, a standard seven foot pool table cover weighs only 5 pounds (2.3 kg), which is remarkably light for a structure of that size.

Yet another object of the invention allows installation and removal of the cover to the table by one person. If the cover were rigid and heavy, as in leaves for a dining table, their own weight makes it difficult for one person to manipulate, particularly for someone of small stature. As the invention is in one piece and folds neatly into a stack for storage, application to a table is quick and easy since it simply unfolds and the skirt is placed over the sides of the table. Removal is also simple and easy requiring only folding the end pieces over on top of each other with another fold in the center making the cover ready for storage.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 1 is a partial isometric view of the preferred embodiment illustrated fitted to a pool table.

FIG. 2 is a cross-sectional view taken along lines 2—2 of FIG. 1.

FIG. 3 is a side elevational view of the preferred embodiment partially cut-away to show the relationship of the top to the blocks and covering.

FIG. 4 is a schematic view of the blocks and the method of folding the outside blocks on top of the inside blocks with dotted lines depicting the radial movement.

BEST MODE FOR CARRYING OUT THE INVENTION

Figure 10:
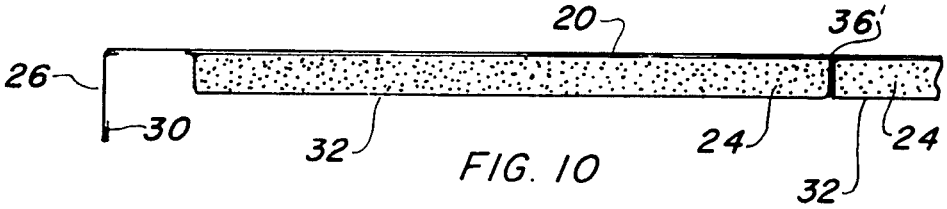
FIG. 10 is a cross-sectional view taken along lines 10—10 of FIG. 6 illustrating the longitudinal cross-section.

The best mode for carrying out the invention is presented in terms of a preferred embodiment. The preferred embodiment, as shown in FIGS. 1 through 11, is comprised of a pliable top 20 large enough to completely overlay a pool or billiard table. The top 20 further contains one or more downwardly depending folds 22. The cover 20 may be a single piece of material or may be two separate sections, as shown in FIG. 10, sewn together at the mating ends forming a unitary top. The fold 22 is important as the compactness of the invention relies upon this feature. While only one fold 22 is illustrated, a plurality may be used for larger tables using the same principle. The top 20 may be of any material, however, a fabric reinforced vinyl is preferred with a tactile outside surface, such as imitation leather, or the like. 11 oz. vinyl material has proven optimum for this application.

A number of rectangular semi-rigid blocks 24 are disposed contiguously with the top 20. Four are preferred, however, any number may be used, each positioned parallel with the other and the two in the center are touching the fold 22 of the top 20, one on each side. The thickness of each block 24 is equal to the recess between the pool table carpeted bed and the top of the cushion supporting frame, as shown in FIG. 2. The combined size of all of the blocks placed side by side completely fills a pool table playing surface. It will be noted that four blocks are illustrated, however, more may be used as long as the quantity is an even number to facilitate folding. The blocks 24 are fabricated of a lightweight material having some structural integrity, however, as the load is in compression between the bed of the pool table and the items placed on the top of the cover, the tensile strength of the material is relatively insignificant. The material, however, must be rigid enough to support a limited amount of compression while being inherently very lightweight. While any number of materials may be used, polystyrene, STYRAFOAM, in the slab block form has proven optimum, however, the invention is not limited to this material alone, as a myriad of other substances may be used with equal ease, as an example, rigid polyurethane foam, or other blown plastic compositions. Honeycomb cardboard has the necessary prerequisites or balsa wood, even hollow blocks formed of thin plywood are rigid enough, at least semi-rigid, allowing a small amount of weight to be placed on the table without collapsing. Other materials include rigid polyester-polyurethane foam, open or closed cell sponge rubber, or EPDM, etc.

Figure 11:
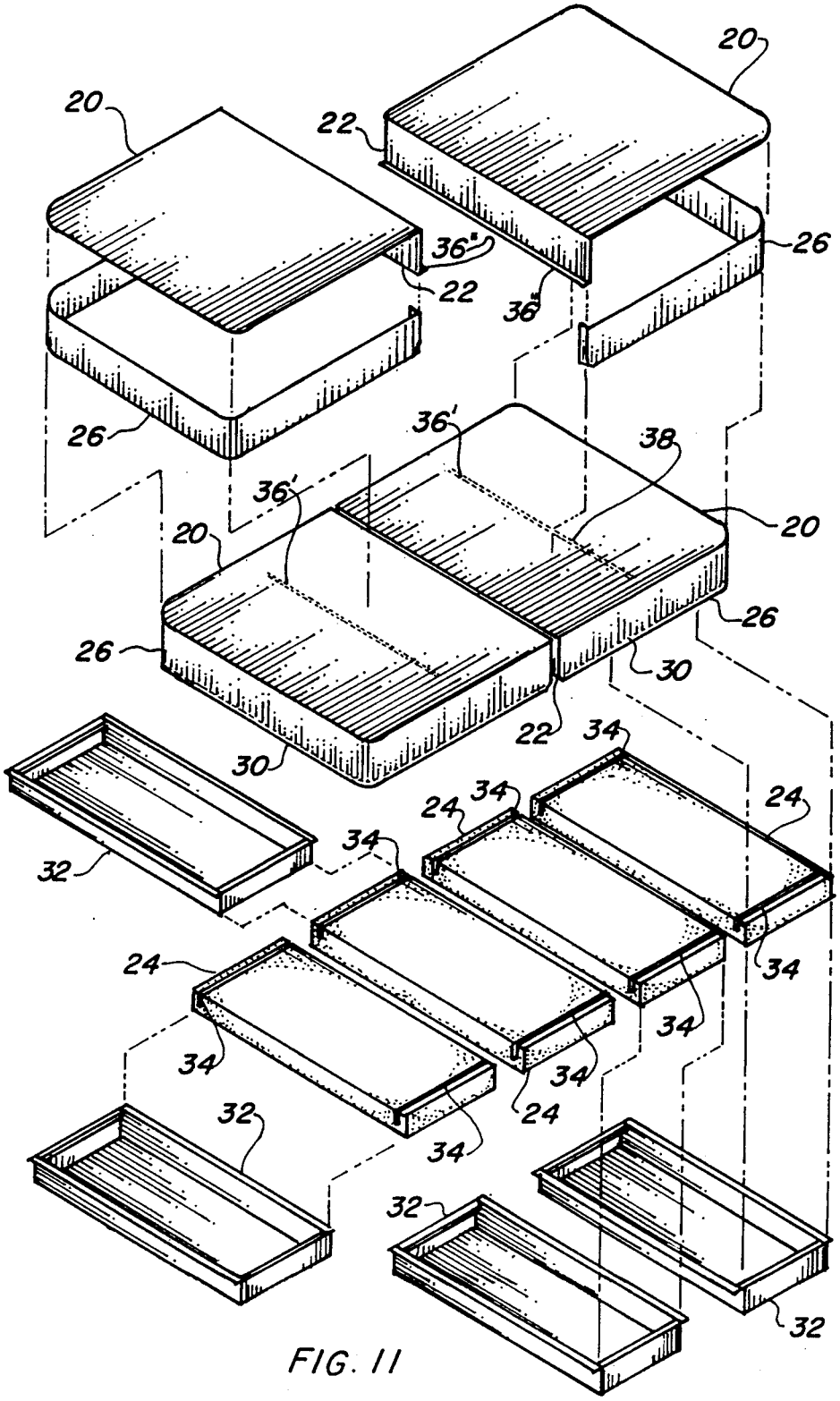
FIG. 11 is an exploded view of the invention.

A peripheral skirt 26 is attached to the outside edge of the top 20 allowing the cover to completely envelope the table, as shown in FIG. 1. This skirt 26 hangs downwardly on the sides and ends and is split in the middle, therefore, being formed in two separate pieces, as illustrated in FIG. 11. The skirt 26 is made of the same material as the top and is overlapped and attached to the top 20 forming a single structure.

A bead 28 may be added at the interface between the edge of the top 20 and the skirt 26. While unnecessary for the invention, this optional feature, while adding no specific utility, does enhance and enrich the cosmetic appearance.

The skirt 26 further contains a hem 30 folded upwardly on the outside edge to add a finished appearance to the cover.

A pliable block covering 32 wraps around the four sides and covers the bottom of the block 26 holding the block tightly in place against the top 20. The covering 32 is one individual piece and is notched on the corners. The longitudinal sides of the covering are attached directly to the top 20 making a snug fit while the narrower ends of the rectangular covering are folded upwardly and inserted into a slot 34 on the narrow end top of the block 24. As these ends are basically open, or at least not attached to the top 20, the arrangement of folding and wedging into the slot may be accomplished after attachment to the top on the longitudinal sides which simplifies assembly and allows a tight fit between components without special tooling. The covering 32 is formed from a material similar to the top 20, however, it is preferably lighter and thinner, as it is not exposed to the same usage or wear. At any rate, the preferred material is a fabric reinforced vinyl or equivalent A so-called 9.7 oz. marine vinyl material has proven to be ideal for this application.

Figure 12:
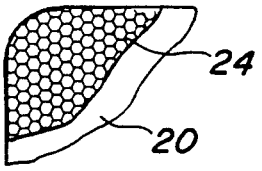
FIG. 12 is a view of the corner of the cover taken from FIG. 6 illustrating a honeycomb cardboard block.
Figure 5:
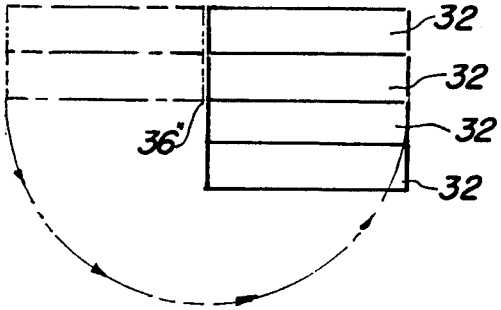
FIG. 5 is a schematic much like FIG. 4, illustrating the cover in its completely closed condition with dotted lines depicting the radial movement.
Figure 6:
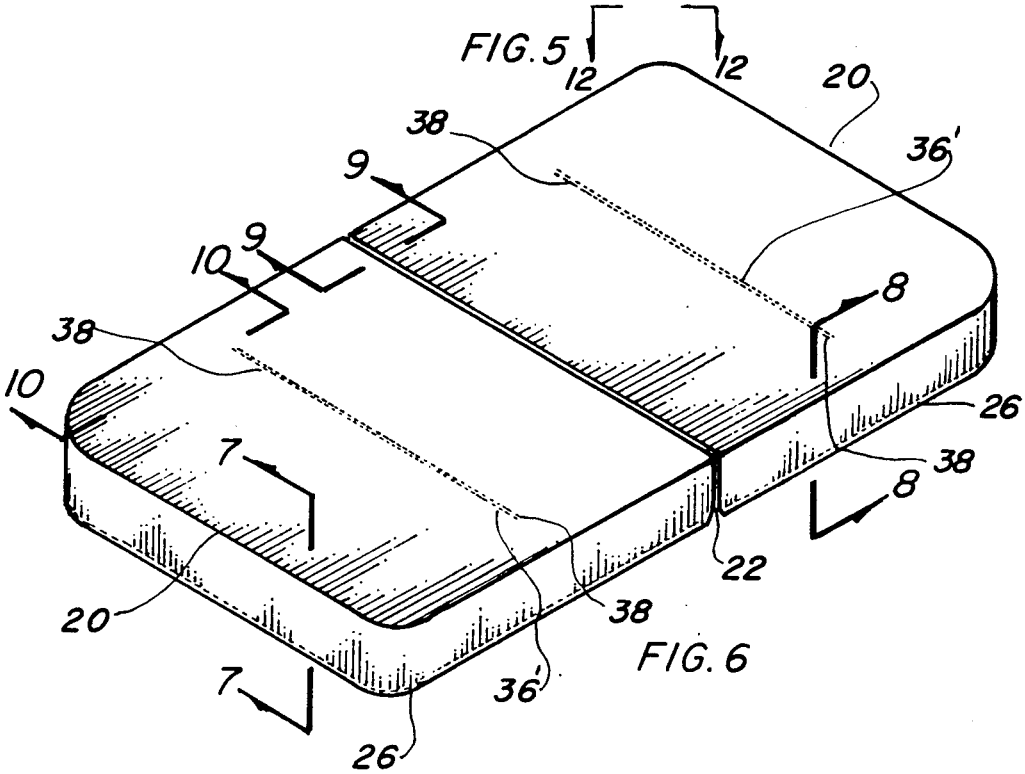
FIG. 6 is a partial isometric view of the table cover completely removed from the table, completely opened.
Figure 7:
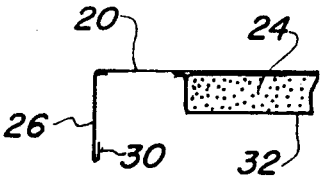
FIG. 7 is a cross-sectional view taken along lines 7—7 of FIG. 6 showing the outside edge.
Figure 8:
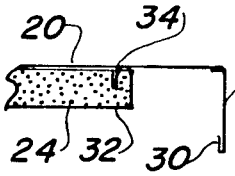
FIG. 8 is a cross-sectional view taken along lines 8—8 of FIG. 6 showing the opposite outside edge.
Figure 9:
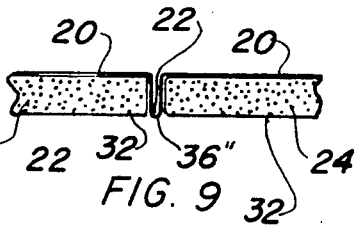
FIG. 9 is a cross-sectional view taken along lines 9—9 of FIG. 6 illustrating the hinging surfaces at the downwardly depending fold.

Integral hinging surfaces 36 are employed in the invention to allow folding of the cover into a storable size. These surfaces are the outside of the top 20 between matching pairs of blocks 24 designated 36′ and the downwardly depending fold 22 in the middle of the invention depicted in FIGS. 3 through 5 as 36″. As more than one fold 22 may be used if more than four blocks 24 are utilized, this hinged surface 36″ may be in multiples. The structure of the hinged surfaces is basically the material of the top 20 itself, as it is sufficiently pliable to function as a hinge. If the material in the top 20 is not flexible enough or subject to cracks and deterioration due to constant bending, a separate piece of material may be employed having suitable, bendable and elastic properties, as the invention is not limited to the parent material of the top as the hinge by itself. At any rate, these hinging surfaces 36 allow the cover to be doubled over with each block 24 on top of the other resulting in a compact pleated device suitable for storage. FIG. 4 depicts schematically the outside blocks hinging on top of the inside blocks and FIG. 5 shows the inside blocks stacked one on the other creating a minimum sized storable package.

The construction of the cover is preferably by stitching with thread 38 on a conventional industrial sewing machine. This attachment means has been found to be acceptable and strong enough to allow complete function of the invention. Other methods of attachment, such as adhesive bonding or seam welding, fusing the material together may also be used with equal impunity.

In use, the device is placed on the pool or billiards table and unfolded, a block at a time, with the skirt 26 placed over the edge of the table. For storage, the reverse procedure is used with the skirt 26 folded into the middle making a compact attached package for depositing in a convenient location.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A foldable pool table cover comprising:

(a) a pliable top having at least one downwardly depending abutting fold, also an outside surface and an inside surface, the cover sized to completely overlay a pool table;

(b) a plurality of contiguous rectangular semi-rigid blocks abutting each other having a thickness equal to the recess between the pool table carpeted bed and uppermost cushion supporting frame with a combined size completely filling the pool table playing surface, the blocks juxtapositioned with the inside of the top creating a level surface on the table;

(c) said pliable top enclosing the blocks therein, for protection and to maintain the contiguous relationship of the blocks to the top; and, (d) said top defining integral hinging surfaces indivisibly disposed on the top between the adjacent matching pairs of blocks and at least one at each downwardly depending fold allowing the cover to be doubled over with each block on top of the other resulting in a compact pleated cover suitable for convenient storage when not in use.

2. The cover as recited in claim 1 wherein said pliable top further comprises; fabric reinforced vinyl having appropriate properties that allow joining by stitching with thread.

3. The cover as recited in claim 2 wherein said fabric reinforced vinyl has an imitation leather texture on the outside surface producing a tactile quality to the cover.

4. The cover as recited in claim 1 further comprising; a peripheral skirt attached to the top allowing the cover to envelope the pool table top, sides, and ends.

5. The cover as recited in claim 4 further comprising; a hem, folded upwardly on said skirt producing a finished appearance to the cover.

6. The cover as recited in claim 1 wherein said semi-rigid blocks further comprise; polystyrene slab.

7. The cover as recited in claim 1 wherein said semi-rigid blocks further comprise; rigid polyurethane foam.

8. The cover as recited in claim 1 wherein said semi-rigid blocks further comprise; honeycomb cardboard.

9. The cover as recited in claim 1 wherein the pliable block covering further comprises; fabric reinforced vinyl.

10. The cover as recited in claim 1 further comprising; thread, formed into stitches defining the attachment of said pliable block covering to said top.

11. A foldable pool table cover comprising:

(a) a pliable top having at least one downwardly depending fold, also an outside surface and an inside surface, said cover being of a size to completely overlay a pool table;

(b) a plurality of rectangular semi-rigid blocks having a thickness equal to the recess between the pool table carpeted bed and the uppermost cushion supporting frame with a combined size completely filling the pool table playing surface, said blocks juxtapositioned with the inside of the top creating a level surface on the table, each block having a slot on opposed ends of the rectangles narrow end allowing the block covering to be retained therein;

(c) a pliable block covering, attached to the top, enclosing the blocks therein, for protection and to maintain the contiguous relationship of the blocks to the top; and, (d) said cover defining integral hinging surfaces disposed on the top between matching pairs of blocks and at least one at each downwardly depending fold allowing the cover to be doubled over with each block on top of the other resulting in a compact pleated cover suitable for convenient storage when not in use.

* * * * *